US009155378B2

(12) United States Patent
Waters

(10) Patent No.: US 9,155,378 B2
(45) Date of Patent: Oct. 13, 2015

(54) ACCESSORY POCKET SYSTEM

(71) Applicant: Anthony Lamar Waters, Miami, FL (US)

(72) Inventor: Anthony Lamar Waters, Miami, FL (US)

( * ) Notice: Subject to any disclaimer, the term of this patent is extended or adjusted under 35 U.S.C. 154(b) by 0 days.

(21) Appl. No.: 14/102,692

(22) Filed: Dec. 11, 2013

(65) Prior Publication Data

US 2014/0312093 A1 Oct. 23, 2014

Related U.S. Application Data

(60) Provisional application No. 61/813,264, filed on Apr. 18, 2013.

(51) Int. Cl.
*A45F 3/00* (2006.01)
*A45F 5/02* (2006.01)

(52) U.S. Cl.
CPC ..... *A45F 5/021* (2013.01); *A45F 3/005* (2013.01); *A45C 2200/10* (2013.01); *A45F 2200/055* (2013.01); *A45F 2200/0516* (2013.01)

(58) Field of Classification Search
USPC ..... 224/681
See application file for complete search history.

(56) References Cited

U.S. PATENT DOCUMENTS

| | | | | |
|---|---|---|---|---|
| 3,361,312 | A | 1/1968 | Hutchison | |
| 5,020,673 | A * | 6/1991 | Adams | 206/581 |
| 5,263,618 | A * | 11/1993 | Talavera | 224/148.5 |
| 5,285,833 | A * | 2/1994 | Haxby | 150/102 |
| 5,397,040 | A * | 3/1995 | Lee | 224/679 |
| 6,073,796 | A * | 6/2000 | Mogil | 220/592.17 |
| 6,651,854 | B1 | 11/2003 | LaCoste | |
| 6,695,189 | B1 | 2/2004 | Dolas | |
| 7,334,714 | B2 | 2/2008 | Brown | |
| 8,225,973 | B1 | 7/2012 | Bellinson | |
| 2005/0133558 | A1 * | 6/2005 | Toombs | 224/576 |
| 2008/0222780 | A1 | 9/2008 | Johnson | |
| 2008/0237288 | A1 * | 10/2008 | Hamilton | 224/645 |
| 2009/0163248 | A1 | 6/2009 | Liang et al. | |
| 2009/0242601 | A1 * | 10/2009 | Inman | 224/602 |
| 2010/0048267 | A1 | 2/2010 | Lin | |
| 2011/0019939 | A1 | 1/2011 | Schwarz | |
| 2011/0077061 | A1 | 3/2011 | Danze et al. | |
| 2011/0089077 | A1 | 4/2011 | Ziemba | |
| 2011/0089078 | A1 | 4/2011 | Ziemba | |
| 2011/0284407 | A1 | 11/2011 | Connolly | |
| 2012/0018266 | A1 * | 1/2012 | Ziv et al. | 190/109 |
| 2012/0021810 | A1 | 1/2012 | Terry | |
| 2012/0190413 | A1 | 7/2012 | Ojeda | |
| 2012/0255978 | A1 | 10/2012 | Williams | |
| 2013/0043285 | A1 * | 2/2013 | Cordray | 224/148.3 |
| 2013/0062372 | A1 * | 3/2013 | Bradford | 224/153 |
| 2013/0075437 | A1 * | 3/2013 | Zinnerman | 224/587 |
| 2013/0256346 | A1 | 10/2013 | Rohrbach et al. | |

* cited by examiner

*Primary Examiner* — Brian D Nash
(74) *Attorney, Agent, or Firm* — Assouline & Berlowe, P.A.; Loren Donald Pearson; Gregory M. Popowitz

(57) ABSTRACT

An accessory pocket system that provides a slim, secure pocket that attaches to a belt loop. The pocket system according to the present invention allows a user to insert documents, credit cards, money and in one particular embodiment a smart phone for safekeeping. The accessory pocket system includes a belt sleeve that allows the insertion of a user's belt to secure the pocket to the individual. The accessory pocket system allows the insertion of passports, credit cards, documents, portable electronic devices or smart phones in a convenient manner so that the user may readily access them.

6 Claims, 4 Drawing Sheets

ACCESSORY POCKET SYSTEM

CROSS REFERENCE TO OTHER APPLICATIONS

This application claims priority to U.S. Provisional Application Ser. No. 61/813,264 filed on Apr. 18, 2013.

BACKGROUND OF THE INVENTION

1. Field of Invention

The present invention relates to an accessory pocket system that provides a means to store documents and/or electronic devices in a discreet manner.

2. Description of Related Art

Many travelers must carry documents such as passports and other important identifying papers while traveling. It is essential that these documents remain with the traveler while traveling especially when traveling outside their native country. Travelers and tourists are susceptible to pick pockets and other thieves who may steal these documents for unscrupulous purposes. Therefore it is essential that the traveler maintains these documents in a safe and secure manner. The common means of storing such documents may be in a pants pocket or purse, however such storage is easily susceptible to a pickpocket.

Further the use of electronic communication devices such as a cellular phone and in particular smart phones has flourished in the recent years. Smart phones are vastly used by a number of people and therefore various storage or transporting devices and carrying pouches have been developed to store and carry smart phones. The use of the smart phone is typically accomplished through touchscreens that are widely used on a number of smart phones that are presently on the market. Touch screens are also utilized on other portable electronic devices such MP3players or other media players. Consequently it would be advantageous to have a secure pocket to access the touch screen on a smart phone or other electronic device and in addition that could provide storage for documents, money, credit cards or other items in a secure position for a user.

SUMMARY OF THE INVENTION

The present invention relates to an accessory pocket system that provides a slim, secure pocket that attaches to a belt loop. The pocket system according to the present invention allows a user to insert documents, credit cards, money and in one particular embodiment a smart phone for safekeeping. The accessory pocket system includes a belt sleeve that allows the insertion of a user's belt to secure the pocket to the individual. The accessory pocket system allows the insertion of passports, credit cards, documents, portable electronic devices or smart phones in a convenient manner so that they may be readily accessed by the user.

DETAILED DESCRIPTION

The present invention relates to an accessory pocket system that is utilized to store documents, money, identification papers, portable electronic devices and in one particular embodiment a cellular phone. The accessory pocket system uses a slim slotted compartmentalized pocket that includes a belt sleeve for attachment to a belt of a user. The belt sleeve allows the user to firmly attach the pocket system to their body and allows the user to place the pocket on the exterior of the user's clothing and in one alternative embodiment allows the user to completely conceal the pocket on the inside of the user's clothing depending on the arrangement or placement of the pocket system on the user's belt. Further the accessory pocket system includes a transparent cover that allows the user to interface with a portable electronic device or smart phone that includes a touchscreen. This transparent cover allows the user to simply view the touch screen to input touch commands to the smartphone via the transparent surface. The user may also attach earphones through openings that may be provided so that the user may easily attach earphones to the smartphone while operating.

Figure 1:
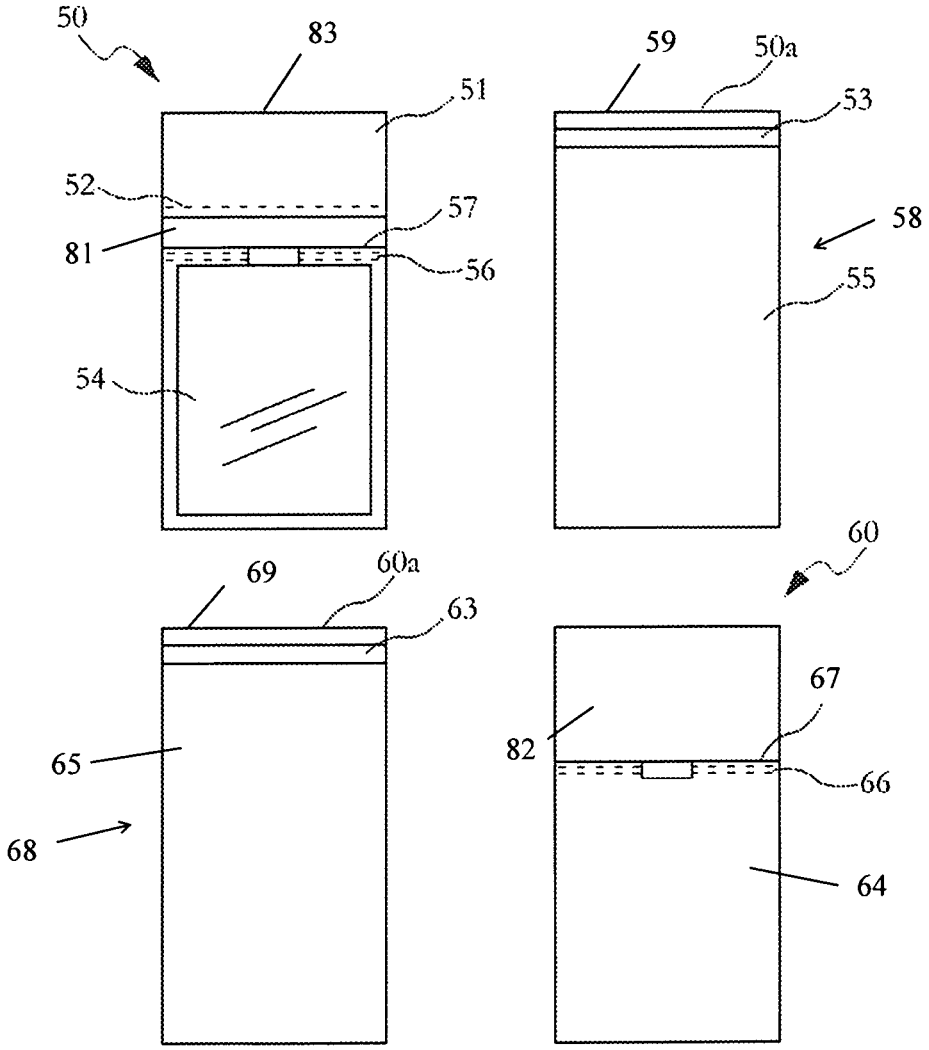
FIG. 1 depicts a first embodiment of an accessory pocket system in accordance with the present invention.

In reference to FIG. 1, a first embodiment of the accessory pocket system in accordance with the present invention is depicted. The first embodiment includes a first pocket 50, 50*a*. The first pocket 50, 50*a* includes a first front panel 50 that sown a transparent cover 54. The transparent cover 54 includes a pocket opening 57 at the top of the transparent cover 54. This pocket opening 57 allows for the insertion of a portable electronic device into the first pocket 50. A belt sleeve 51 is shown above the first pocket opening 57 with stitching 52 depicted therein. The belt sleeve 51 has an upper edge 83. The upper edge is not higher than the opening of the opening of the third pocket, which is defined by the top 59 of the first front panel 50 and the top 69 of the second front panel 60. This belt sleeve 51 enables the user to slide a belt through the belt sleeve 51 and therefore attached the pocket assembly onto their belt.

The transparent cover 54 forms a first pocket for insertion of the portable electronic device. This pocket is sealed by the use of a hook and loop connector 56 shown in FIG. 1. This hook and loop connector 56 is on the inside of the top border of the transparent cover 54. The first pocket further includes a first front panel 50. The first front panel 50 has an outside pocket surface 81. The transparent cover 54 is disposed on the outside pocket surface 81. The inside panel 58 is the reverse or rear portion of the front panel 50. This inside panel 58 includes an inside pocket surface 55. An additional hook and loop connector 53 is depicted at the top 59 of the inside pocket surface 55. Next to the inside panel 58 is a second inside panel 68, which is the reverse side of a second front panel 60 also shown in FIG. 1. The second front panel 60 includes a pocket opening 67 that is also closed through the use of a hook and loop connector 66. In this particular pocket a user may store credit cards, money, passport, or other items that may be desired. The inside panel 68 of the second front panel 60 includes a hook and loop connector 63 and an inside pocket surface 65. The hook and loop connector 63 is depicted at the top 69 of the inside pocket surface 65. The hook and loop connector 63 joins with the hook and loop connector 53 of the first inside panel 58 to create a third inside pocket once the first panel 50 and the second panel 60 are joined together. This configuration therefore creates the three pockets available for use by a user. All pockets are closed through the use of hook and loop connectors. Further the pocket designated for the cellular smart phone includes the transparent cover 54.

Figure 2:
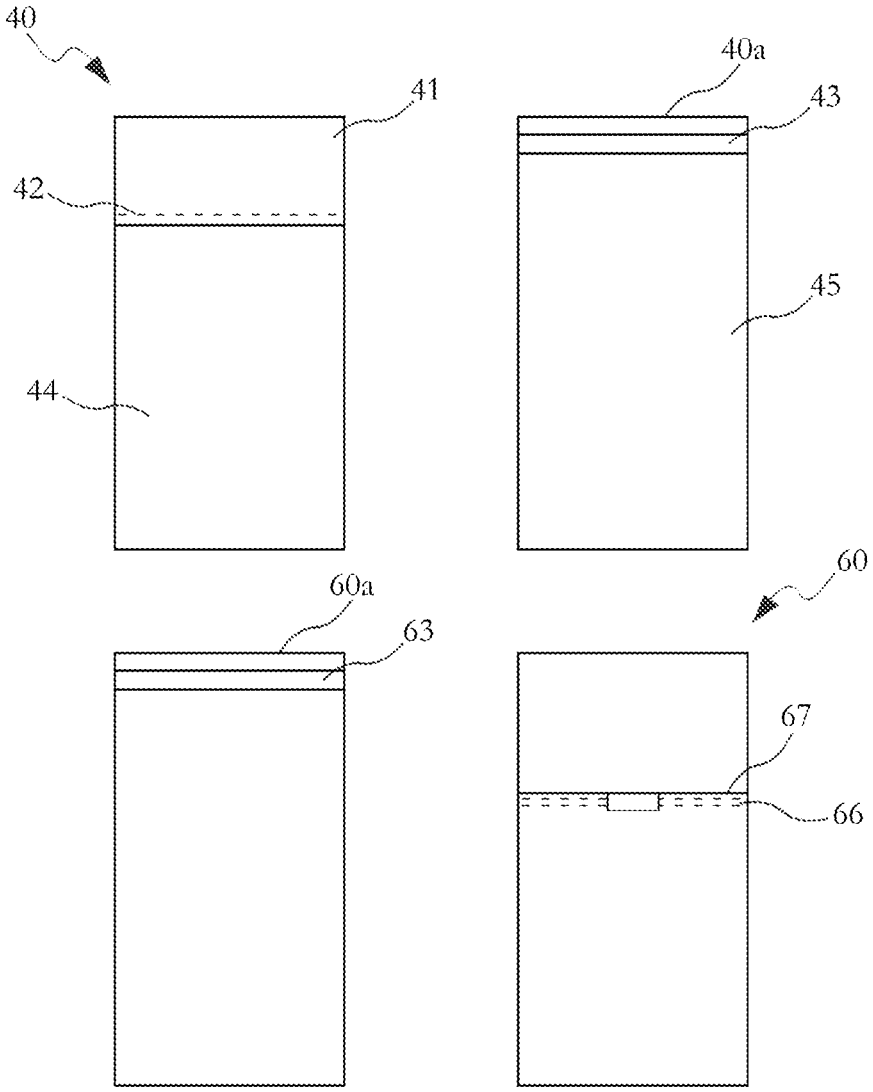
FIG. 2 depicts a second embodiment of the accessory pocket system in accordance with the present invention.

FIG. 2 depicts an alternative embodiment of the accessory pocket system according to the present invention. The alternative accessory pocket system of FIG. 2 is essentially two pockets that are available using a panel system similar to what is depicted in FIG. 1. However the panel system of FIG. 2 includes an alternative first outside panel 40. This first outside panel does not have an outside pocket and is shown with an outside surface 44. Above outside surface 44 is a belt sleeve 41 stitched with stitching 42. This outside panel 40 includes an inside panel 48 that has an inside pocket surface 45. Above the inside pocket surface 45 is a hook and loop connector 43, which joins with the inside panel 68 as shown in FIG. 2 and creates the inside pocket with the closure of the hook and loop connector 63 with hook and loop connector 43. The opposing inside pocket surface 65 is also depicted. Therefore a inside pocket is created with this second embodiment with along with the outside pocket opening 67 as described above.

Figure 3:
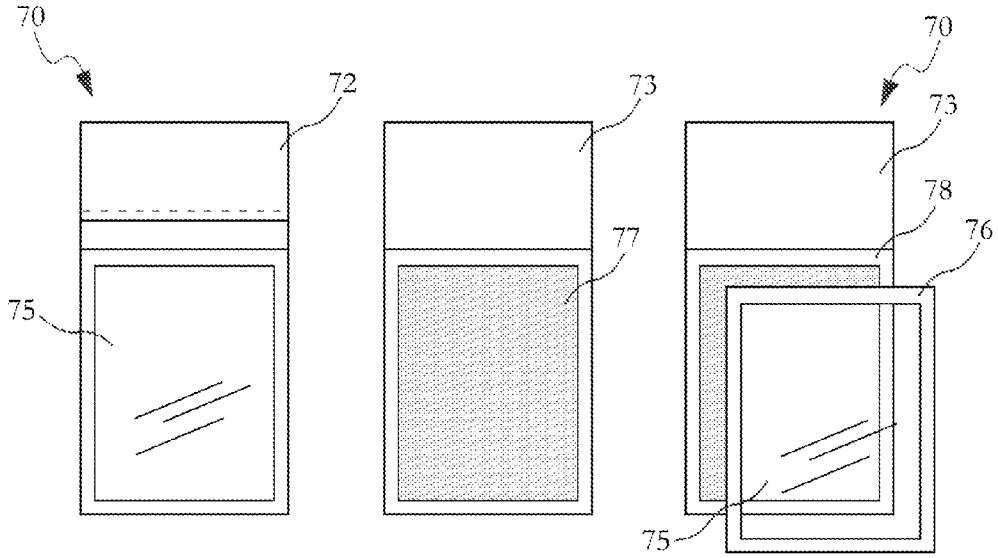
FIG. 3 depicts a third embodiment of the accessory pocket system in accordance with the present invention.

In reference to FIG. 3, a third embodiment of the accessory pocket system according to the present invention is depicted. The third embodiment provides a pocket system 70 for the insertion and storage of a cellular smart phone. The features related to this particular accessory pocket include a transparent cover 75 as shown. This transparent cover 75 is sealed onto a mesh backing 77. The accessory pocket further includes a belt sleeve 72 as shown. The belt sleeve 72 again provides a means to secure the pocket system onto the belt of a user. The mesh backing 77 enables the clear transmission of any audio that is emitted from the cell phone within the transparent pocket sleeve 75. Also shown in FIG. 3 is the hook and loop connector 78 that extends along the border of the mesh backing 77 and along the inside border of the transparent cover 75. The inside cover 76 includes an additional hook and loop connector that adjoins to the hook and loop connector 78. This feature allows a user to completely peel the transparent cover 75 off of the pocket system and allows the user to insert a cellular phone into this area. Once the cellular phone is placed in this area it is safely sealed and is accessible through the transparent cover 75.

Figure 4:
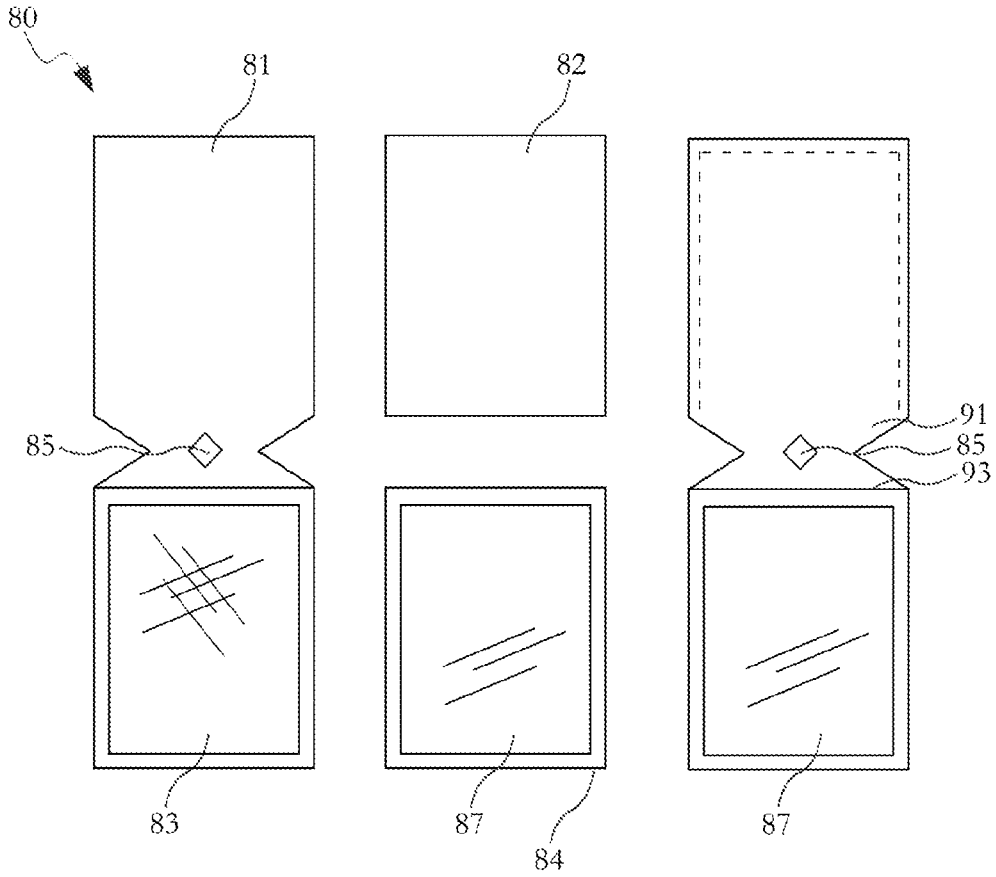
FIG. 4 depicts a fourth embodiment of the accessory pocket system in accordance with the present invention.

With respect to FIG. 4, a fourth alternative embodiment is depicted in the present invention. This fourth alternative embodiment includes a dual pocket panel 80. The dual pocket panel 80 includes a first rear panel 81 adjoined to a mesh panel 83. Initially the rear configuration of the pocket panel 80 is shown. An opening 85 is provided that allows a user to transfer any cords related to a headphone through this opening as this pocket system 80 is utilized. A front pocket panel 82 is depicted in the FIG. 4 along with a clear cover panel 87. This clear cover panel 87 includes the border 84 that adjoins to the mesh panel 83 as shown in FIG. 4. This feature allows the user to adjoin the clear cover panel 87 to the mesh backing 83 similar to the embodiment shown in FIG. 3. Above this clear cover panel 87 is the enclosed pocket opening 91. This pocket opening 91 allows for the insertion of documents, credit cards or other similar items into the sleeve provided. The configuration of this pocket panel 80 allows a user to simply fold the interior documents on the inside of their clothing and allow the outside of the pocket panel 80 to remain exposed and therefore allow access to a cellular phone placed in the pocket panel 87. Opening 93 is provided for the insertion of a portable electronic device such as a cellular phone with a touch screen that may be left open or may be closed through the use of hook and loop connectors on the rear panel side.

The present invention consequently provides a pocket system for storage of both documents, money, credit cards, items and in addition may be utilized for portable electronic device storage. The system conveniently creates a system to securely maintain these items on a user's person.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed:

1. An accessory pocket system for storing an item, comprising: a first front panel having a top, an inside pocket surface with a perimeter, and an outside pocket surface; a second front panel having a top, an inside pocket surface with a perimeter, and an outside pocket surface, a portion of said perimeter of said inner surface of said second front panel being connected to a portion of said perimeter of said inner surface of said first front panel with said top of first front panel and said top of said second panel remaining openable to define a pocket; and a belt sleeve being disposed on said outside pocket surface of said first front panel and having an upper edge, said upper edge being no higher than said top of said first front panel; further comprising: a transparent cover disposed on said outside pocket surface of said first front panel; further comprising a second front panel being disposed on an exterior of said second inside panel.

2. The accessory pocket system according to the claim 1, further including a first hook and loop connector disposed on said outside pocket surface of the first front panel; and a second hook and loop connector disposed on said transparent cover and connected to said first hook and loop connector.

3. The accessory pocket system according to claim 1, wherein said second front panel includes a mesh backing.

4. An accessory pocket system for storing an item, comprising: a first front panel having a top, an inside pocket surface with a perimeter, and an outside pocket surface; a second front panel having a top, an inside pocket surface with a perimeter, and an outside pocket surface, a portion of said perimeter of said inner surface of said second front panel being connected to a portion of said perimeter of said inner surface of said first front panel with said top of first front panel and said top of said second panel remaining openable to define a pocket; and a belt sleeve being disposed on said outside pocket surface of said first front panel and having an upper edge, said upper edge being no higher than said top of said first front panel; and wherein a hook and loop connector is on the first inside panel and a hook and loop connector is on the second inside panel to close an inside pocket formed by the inside panels.

5. An accessory pocket system for storing an item, comprising: a first front panel having a top, an inside pocket surface with a perimeter, and an outside pocket surface; a second front panel having a top, an inside pocket surface with a perimeter, and an outside pocket surface, a portion of said perimeter of said inner surface of said second front panel being connected to a portion of said perimeter of said inner surface of said first front panel with said top of first front panel and said top of said second panel remaining openable to define a pocket; and a belt sleeve being disposed on said outside pocket surface of said first front panel and having an upper edge, said upper edge being no higher than said top of said first front panel; and wherein said first front panel is a transparent cover.

6. The accessory pocket system according to claim 5 wherein: said second front panel includes a mesh panel; and a hook and loop connector joins the transparent cover and the mesh panel.

* * * * *